United States Patent [19]

Rubin

[11] 4,168,479

[45] Sep. 18, 1979

[54] MILLIMETER WAVE MIC DIPLEXER

[75] Inventor: David Rubin, San Diego, Calif.

[73] Assignee: The United States of America as represented by the Secretary of the Navy, Washington, D.C.

[21] Appl. No.: 844,563

[22] Filed: Oct. 25, 1977

[51] Int. Cl.[2] ..... H01P 5/12; H01P 1/20

[52] U.S. Cl. ..... 333/126; 333/128; 333/204

[58] Field of Search ..... 333/6, 9, 2, 73 S; 325/23, 24; 343/180

[56] References Cited

U.S. PATENT DOCUMENTS

| | | | |
|---|---|---|---|
| 2,984,802 | 5/1961 | Dyer et al. | 333/73S |
| 3,428,918 | 2/1969 | Matthaei | 333/6 |
| 3,656,162 | 4/1972 | Mee | 333/6 UX |
| 3,733,608 | 5/1973 | McGhay et al. | 333/6 X |
| 3,818,389 | 6/1974 | Fisher | 333/73 S X |
| 4,080,601 | 3/1978 | Alcorn, Jr. | 325/24 X |

OTHER PUBLICATIONS

Cohn, *Parallel-Coupled Transmission-Line-Resonator Filters,* IRE Trans. on MTT, Apr. 1958, pp. 223-231.

*Primary Examiner*—Paul L. Gensler

*Attorney, Agent, or Firm*—R. S. Sciascia; G. J. Rubens; H. Fendelman

[57] ABSTRACT

A millimeter wave MIC diplexer constructed in either stripline or microstrip comprising two edge coupled bandpass filters separated by specific lengths of transmission lines designed to separate two bands of frequencies. Input signals having frequencies within a first band are passed through one of the bandpass filters while being isolated from the other and input signals having frequencies within a second band are passed through the other bandpass filter while being isolated from the first filter.

11 Claims, 2 Drawing Figures

MILLIMETER WAVE MIC DIPLEXER

BACKGROUND OF THE INVENTION

The present invention relates generally to the field of diplexers and, more specifically, to the field of diplexers constructed in stripline and microstrip. Various filter arrangements have been used in wave guide and stripline. Most of these arrangements are unsuitable for microstrip at millimeter wave frequencies where no tuning procedures can be used and filters requiring grounded sections generally can not be used.

Comb-line filter arrangements have been used in the past for broad band diplexers. These filters, however, require ground connections which degrade performance at millimeter wave frequencies.

SUMMARY OF THE INVENTION

The present invention relates to a diplexer constructed in either microstrip or stripline that may be used to frequency divide a single wide band into two frequency bands. The two channels may be contiguous or separated by several GHz. The diplexer of the present invention is suitable for use in wide band surveillance receivers or in communicators which have transmitting and receiving frequencies far separated. Further, the diplexer according to the present invention can be used to transmit through one branch and can receive through another branch simultaneously or it can be used to transmit (or receive) two different frequencies simultaneously. Moreover, since no grounding lines are necessary in the present invention, the diplexer as disclosed herein is particularly useful at millimeter wave frequencies. Additionally, since it is constructed in either microstrip or stripline, it has the advantage of extremely low cost, ease of manufacture and small size.

Briefly, the diplexer of the present invention is designed by computing the input impedances of two separate edge couple filters having, for example, four GHz bandwidths and centered, for example, at 32 and 36 GHz respectively. These filters are almost totally reactive outside their bandwidths. The device is essentially completed by adding an appropriate length of transmission line in front of each filter such that each filter is made to appear as an open circuit at the center frequency of the other. The completed construction results in a diplexer which suffers virtually no power loss while maintaining a wholly adequate degree of isolation between the two branches.

STATEMENT OF THE OBJECTS OF THE INVENTION

Accordingly, it is a primary object of the present invention to disclose a compact and inexpensive means of separating two bands of frequencies.

It is a further object of the present invention to disclose a relatively wide band diplexer suitable for use in the millimeter wave frequency range.

It is another object of the present invention to disclose a novel diplexer that requires no connections to ground, thereby avoiding the performance degradation created by such ground connections at millimeter wave frequencies.

Other objects and many of the attendant advantages of this invention will be readily appreciated as the same becomes better understood by reference to the following detailed description when considered in connection with the accompanying drawings.

DESCRIPTION OF THE PREFERRED EMBODIMENT

Figure 1:
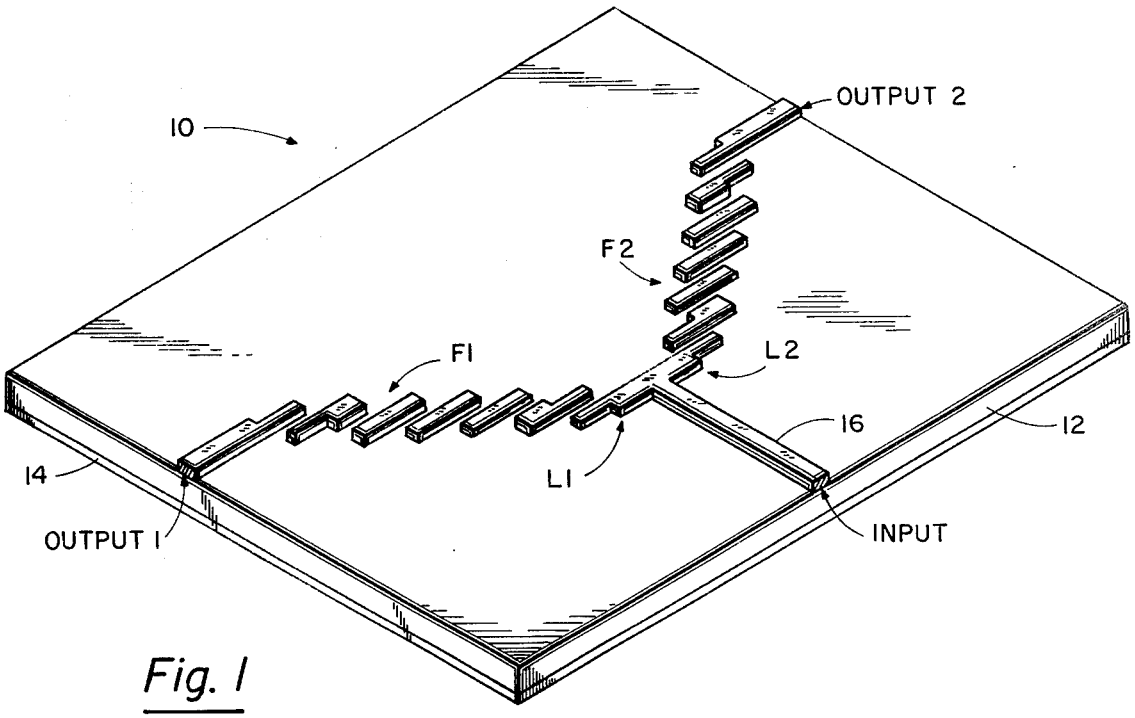
FIG. 1 is an isometric view of a microstrip embodiment of the present invention.

Referring now to FIG. 1 there is illustrated the microstrip version of the diplexer 10 in accordance with the present invention. The diplexer 10 is constructed on any suitable type dielectric substrate 12 such as, for example, irradiated polyolefin or glass fiber impregnated teflon available under the trade name Duroid. The dielectric substrate 12 has affixed thereto a ground plane conductor 14 on the underside thereof. The ground plane conductor 14 may be applied by any of the well known metal cladding techniques.

In accordance with the present invention, the diplexer 10 incorporates a first edge coupled bandpass filter F1 and a second edge coupled bandpass filter F2. A detailed description of the edge coupled bandpass filters is given in the article by S. B. Cohn, "Parallel-Coupled Transmission-Line-Resonator Filters", IRE Trans. PGMTT, volume MTT-6, pp. 223–231 (April 1958). The bandpass filter F1 has a center frequency of $f_1$ and the bandpass filter F2 has a center frequency of $f_2$. The passbands of the two filters can be either contiguous or separated by several GHz. The filters F1 and F2 are formed on the dielectric 12 by any suitable techniques such as, for example, photo etching as is the input transmission line 16 and the junction transmission lines L1 and L2 to be described below. Strip thicknesses are generally as thin as possible without forming holes in the etching process.

At frequencies outside of the bandpass of the filters F1 and F2, each filter, respectively, has a reactive input. This reactance would normally parallel the input impedance of the opposite filter thereby causing a mismatch at the input 16 to the diplexer. Lines L1 and L2 transform the reactive inputs of each filter so that they appear at the center frequency of the opposite filter as an open circuit. In order to determine the required length for the line L1 the input impedance of filter F1 is calculated at $f_2$ and by using a Smith chart, for example, the length of L1 necessary to convert the filter F1 input reactance to an open circuit at the frequency $f_2$ is determined. Similarly, the length of L2 is determined by computing the length necessary to convert the input reactance of the filter F2 to an open circuit to signals at the frequency $f_1$.

Figure 2:
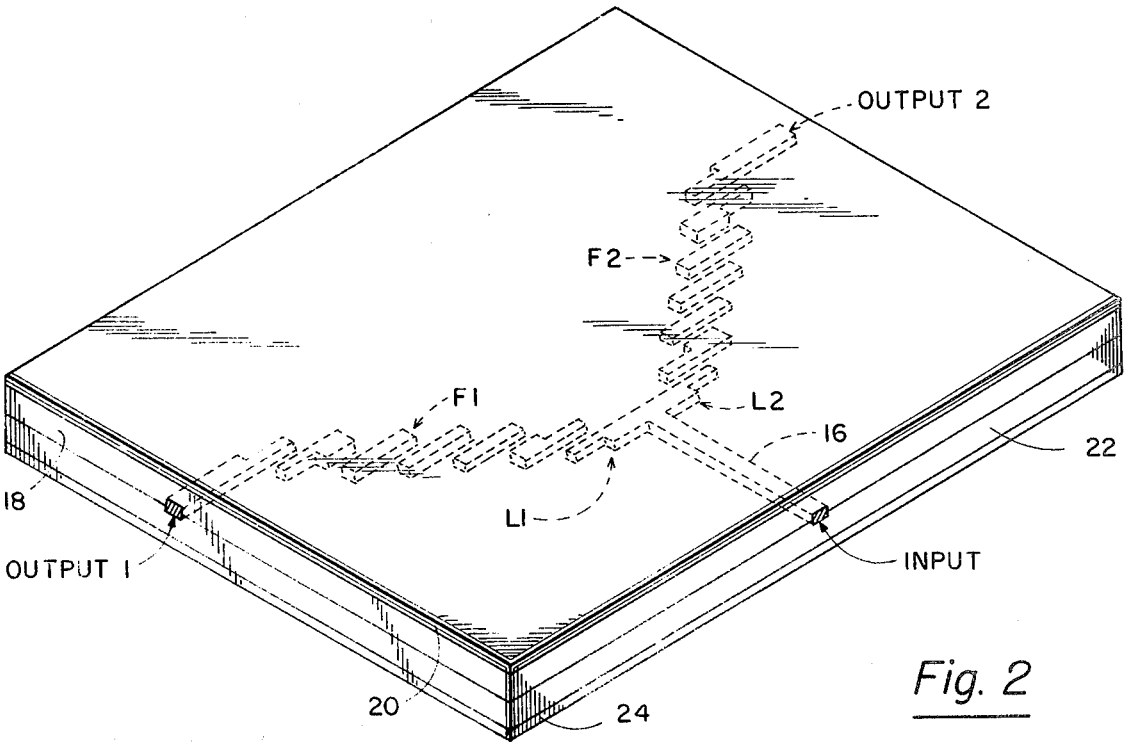
FIG. 2 is an isometric view of a stripline version of the diplexer of the present invention.

FIG. 2 illustrates the stripline version of the present invention. This stripline embodiment includes a first sheet of dielectric 18 having a ground plane 20 disposed thereon and a second sheet of dielectric 22 having ground plane 24 disposed thereon. The stripline circuit including the first bandpass filter F1, the second bandpass filter F2, the input line conductor 16 and the junction conductors L1 and L2 is sandwiched between the two dielectrics 18 and 22 in a well known manner to form the stripline diplexer. Grounding pins (not shown) to prevent propagation in modes other than the TEM mode may be used in this embodiment as is well known.

The microstrip and stripline diplexers disclosed herein operate as follows. For the case where an input signal having components within two frequency bands (i.e., the passbands of F1 and F2) is applied to the input at 16, the component within the first frequency band will "see" an open circuit in the path through F2. Essentially, no reflection will occur and the entire signal will pass through bandpass filter F1. Similarly, the component in the other frequency band will "see" an open circuit in the path through F1. Essentially no reflection will occur and the entire signal component in that band will pass through bandpass filter F2. The diplexer may also be operated for simultaneous transmission and reception. Transmission of a signal may be accomplished, for instance, within the passband of filter F1 with propagation out output 1 while, simultaneously, a signal within the bandpass of F2 is being received at output 2.

Obviously many modifications and variations of the present invention are possible in the light of the above teachings. It is therefore to be understood that within the scope of the appended claims the invention may be practiced otherwise than as specifically described.

What is claimed is:

1. A microstrip diplexer comprising:

a sheet of dielectric material having first and second opposing surfaces;

a ground plane conductor disposed on said second surface;

a first bandpass filter disposed on said first surface and having a passband centered around the frequency $f_1$;

a second bandpass filter disposed on said first surface and having a passband centered around the frequency $f_2$;

an input microstrip conductor disposed on said first surface; and junction means disposed on said first surface operably coupled to said input microstrip conductor and to said first and second bandpass filters for passing signals having frequencies within said first passband to said first passband filter while presenting an open circuit at the input of said first passband filter to signals having frequencies within said second passband and for passing signals having frequencies within said second passband while presenting an open circuit at the input of said second passband filter to signals having frequencies within said first passband, said junction means comprising a strip conductor having a first conductor section connected between said input microstrip conductor and said first bandpass filter, and a second conductor section connected between said input microstrip conductor and said second bandpass filter, said first conductor section having an electrical line length so as to present an open circuit to signals at the frequency $f_2$, and said second conductor section having an electrical line length so as to present an open circuit to signals at the frequency $f_1$.

2. The microstrip diplexer of claim 1 wherein said first and second bandpass filters are edge coupled filters.

3. The diplexer of claim 1 wherein said first and second conductor sections are colinear.

4. The diplexer of claim 3 wherein said first and second bandpass filters are edge coupled bandpass filters.

5. The diplexer of claim 4 wherein said first and second colinear sections each have portions thereof which have widths equal to the width of said input microstrip conductor.

6. A microstrip diplexer comprising:

a sheet of dielectric material having first and second opposing surfaces;

a ground plane conductor disposed on said second surface;

a first bandpass filter disposed on said first surface and having a passband centered around the frequency $f_1$;

a second bandpass filter disposed on said first surface and having a passband centered around the frequency $f_2$;

an input microstrip conductor disposed on said first surface;

first means operably coupled between said input microstrip conductor and said first bandpass filter for presenting an open circuit to signals at the frequency $f_2$; and second means operably coupled between said input microstrip conductor and said second bandpass filter for presenting an open circuit to signals at the frequency $f_1$;

said first means consisting of a first microstrip conductor connected between said first bandpass filter and said input microstrip conductor and having an electrical length so as to convert the reactive input of said first bandpass filter to an open circuit to signals at the frequency $f_2$; and said second means consisting of a second microstrip conductor connected between said second bandpass filter and said input microstrip conductor and having an electrical length so as to convert the reactive input of said second bandpass filter to an open circuit to signals at the frequency $f_1$.

7. The diplexer of claim 6 wherein said first and second bandpass filters are edge coupled bandpass filters.

8. The diplexer of claim 6 wherein said first and second means are colinear line conductors.

9. A stripline diplexer comprising:

a layer of dielectric material having first and second opposing surfaces;

first and second ground planes disposed on said first and second surfaces, respectively;

a first stripline bandpass filter disposed in a plane within said layer of dielectric material intermediate said first and second opposing surfaces and having a passband centered around the frequency $f_1$;

a second stripline bandpass filter disposed in a plane within said layer of dielectric material, intermediate said first and second opposing surfaces and having a passband centered around the frequency $f_2$;

an input stripline conductor disposed on said plane; and stripline junction means disposed on said plane, operably coupled to said first and second bandpass filters and to said input stripline conductor for passing signals within said first passband to said first bandpass filter while presenting an open circuit at the input of said first bandpass filter to signals at the frequency $f_2$ and for passing signals having frequencies within said second passband to said second bandpass filter while presenting an open circuit at the input of said second bandpass filter to signals at the frequency $f_1$, said junction means consisting of a stripline conductor having a first stripline conductor section connected between said input stripline conductor and said first bandpass filter and having an electrical length so as to present an open circuit to signals at the frequency $f_2$, and a second stripline conductor section connected between said input stripline conductor and said second bandpass filter and having an electrical length so as to present an open circuit to signals at the frequency $f_1$.

10. The stripline diplexer of claim 9 wherein said first and second bandpass filters are edge coupled filters.

11. The stripline conductor of claim 9 wherein said first and second sections form a straight line.

* * * * *